US011005171B2

(12) United States Patent
Sugimoto et al.

(10) Patent No.: US 11,005,171 B2
(45) Date of Patent: May 11, 2021

(54) ANTENNA DEVICE

(71) Applicant: DENSO CORPORATION, Kariya (JP)

(72) Inventors: Yuji Sugimoto, Nisshin (JP); Shiro Koide, Kariya (JP); Hiroyuki Izumi, Obu (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/373,675

(22) Filed: Apr. 3, 2019

(65) Prior Publication Data

US 2019/0229411 A1 Jul. 25, 2019

Related U.S. Application Data

(63) Continuation of application No. PCT/JP2017/034828, filed on Sep. 27, 2017.

(30) Foreign Application Priority Data

Oct. 5, 2016 (JP) ..... JP2016-197466

(51) Int. Cl.
*H01Q 9/04* (2006.01)
*H01Q 1/42* (2006.01)
(Continued)

(52) U.S. Cl.
CPC ..... *H01Q 1/42* (2013.01); *H01Q 1/48* (2013.01); *H01Q 9/0407* (2013.01);
(Continued)

(58) Field of Classification Search
CPC .. H01Q 9/0464; H01Q 9/0471; H01Q 9/0428; H01Q 9/065; H01Q 9/005;
(Continued)

(56) References Cited

U.S. PATENT DOCUMENTS

2003/0214443 A1* 11/2003 Bauregger ..... H01Q 3/247 343/700 MS
2009/0015354 A1 1/2009 Kim et al.
(Continued)

FOREIGN PATENT DOCUMENTS

JP 2008236362 A 10/2008
JP 2009021594 A 1/2009
(Continued)

*Primary Examiner* — Awat M Salih
(74) *Attorney, Agent, or Firm* — Hamess, Dickey & Pierce, P.L.C.

(57) ABSTRACT

An antenna device includes a ground plate that is a plate-shaped conductor member, a patch portion that is a plate-shaped conductor member placed to be opposed to the ground plate with a predetermined distance therebetween, a short-circuit portion that is a conductor member electrically connecting together the patch portion and the ground plate, and an additional conductor that is a plate-shaped conductor member placed to be opposed to the patch portion with a predetermined distance therebetween. The additional conductor is placed on a side of the patch portion on which the ground plate is not placed. An inductance of the short-circuit portion, a capacitance formed by the ground plate and the patch portion, and a capacitance formed by the patch portion and the additional conductor are used to perform parallel resonance.

7 Claims, 3 Drawing Sheets

(51) Int. Cl.

| | |
|---|---|
| ***H01Q 13/08*** | (2006.01) |
| ***H01Q 13/10*** | (2006.01) |
| ***H01Q 1/48*** | (2006.01) |
| ***H01Q 15/00*** | (2006.01) |

(52) U.S. Cl.
CPC ..... *H01Q 13/08* (2013.01); *H01Q 13/10* (2013.01); *H01Q 15/0086* (2013.01)

(58) Field of Classification Search
CPC ..... H01Q 21/065; H01Q 1/42; H01Q 1/48; H01Q 15/0086; H01Q 13/08; H01Q 13/10
See application file for complete search history.

(56) References Cited

U.S. PATENT DOCUMENTS

| | | | | |
|---|---|---|---|---|
| 2011/0210906 | A1 | 9/2011 | Maruyama et al. | |
| 2011/0285602 | A1 | 11/2011 | Ryou et al. | |
| 2012/0007786 | A1 | 1/2012 | Ando et al. | |
| 2013/0002377 | A1 | 1/2013 | Toyao et al. | |
| 2015/0091760 | A1* | 4/2015 | Sawa | H01Q 5/385 343/700 MS |
| 2016/0190704 | A1* | 6/2016 | Celik | H01Q 9/0435 343/700 MS |
| 2017/0309992 | A1* | 10/2017 | Noori | H01Q 1/2258 |

FOREIGN PATENT DOCUMENTS

| | | | |
|---|---|---|---|
| JP | 2012508538 | A | 4/2012 |
| JP | 2012257315 | A | 12/2012 |
| JP | 5527316 | B2 | 6/2014 |
| JP | 2014120989 | A | 6/2014 |
| JP | 2015142224 | A | 8/2015 |
| WO | WO-2011114746 | A1 | 9/2011 |

* cited by examiner

ANTENNA DEVICE

CROSS REFERENCE TO RELATED APPLICATIONS

The present application is a continuation application of International Patent Application No. PCT/JP2017/034828 filed on Sep. 27, 2017, which designated the United States and claims the benefit of priority from Japanese Patent Application No. 2016-197466 filed on Oct. 5, 2016. The entire disclosures of all of the above applications are incorporated herein by reference.

TECHNICAL FIELD

The present disclosure relates to an antenna device having a flat plate structure using zero-order resonance, which is an application technique of metamaterials.

BACKGROUND

As an antenna device utilizing a zero-order resonance, there is an antenna device including a plate-like metal conductor (hereinafter referred to as ground plate) that is connected to an external conductor of a feeder cable and functions as a ground cable, a plate-like metal conductor (hereinafter referred to as patch portion) that is disposed so as to face the ground plate and provided with a feeding point at any position, and a short-circuit portion that electrically connects the ground plate and the patch portion.

SUMMARY

An antenna device in an aspect of the present disclosure includes a ground plate that is a plate-shaped conductor member, a patch portion that is a plate-shaped conductor member placed to be opposed to the ground plate with a predetermined distance therebetween, a short-circuit portion that is a conductor member electrically connecting together the patch portion and the ground plate, and an additional conductor that is a plate-shaped conductor member placed to be opposed to the patch portion with a predetermined distance therebetween. The additional conductor is placed on a side of the patch portion on which the ground plate is not placed. An inductance of the short-circuit portion, a capacitance formed by the ground plate and the patch portion, and a capacitance formed by the patch portion and the additional conductor are used to perform parallel resonance.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
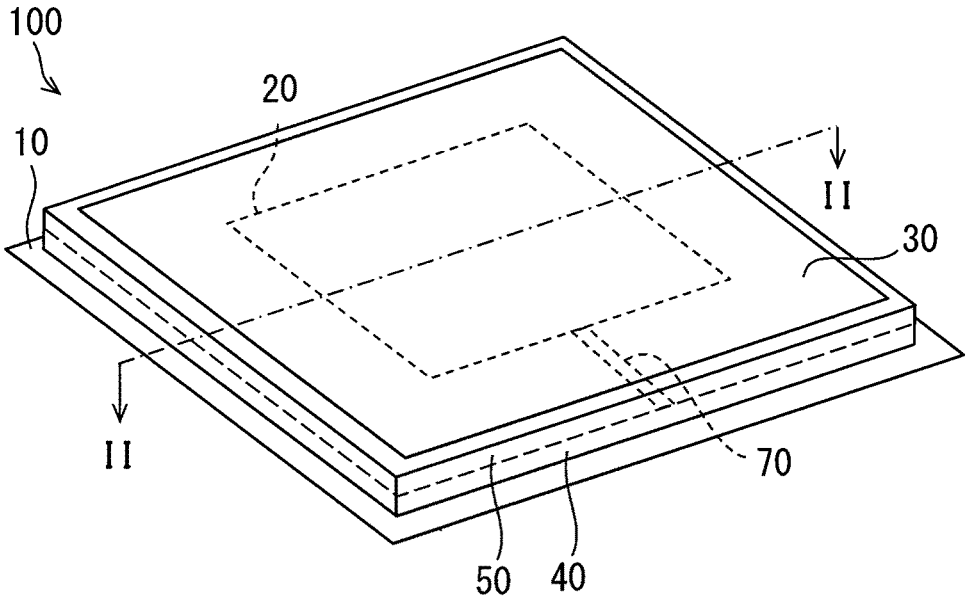
FIG. 1 is a schematic external perspective view of an antenna device 100.

In an exemplary antenna device, a capacitance formed between the ground plate and the patch portion and an inductance of the short-circuit portion cause a parallel resonance at a frequency corresponding to the capacitance and the inductance. The capacitance formed between the ground plate and the patch portion is determined according to an area of the patch portion.

In the antenna device having the configuration described above, with the adjustment of the area of the patch portion or the adjustment of a distance between the ground plate and the patch portion, a frequency to be transmitted and received in the antenna device (hereinafter referred to as a target frequency) can be set to a desired frequency.

The exemplary antenna device has a configuration in which a spiral pattern as a helical load is provided on a portion of the ground plate connected to the short-circuit portion. The introduction of the spiral pattern at the connection portion between the ground plate and the short-circuit portion increases the inductance contributing to the generation of the parallel resonance. For that reason, the antenna device to which the spiral pattern is introduced can reduce the resonance frequency (in other words, a target frequency) as compared with the antenna device to which the spiral pattern having the patch portion of the same size is not introduced.

A fact that the target frequency can be reduced while maintaining the area of the patch portion means that the area of the patch portion can be reduced when the same frequency is used as the target frequency. The fact that the area of the patch portion can be reduced means that an area of the antenna device in a top view (hereinafter referred to as an antenna area) can be reduced. In other words, the configuration of the exemplary antenna device can also be used for a reduction in the area of the antenna.

Further miniaturization of the antenna device is desired. In the configuration of the exemplary antenna device, the inductance is increased with the provision of the spiral pattern on the ground plate, to thereby realize a reduction in the area of the antenna. For that reason, in order to further reduce the antenna area with the use of the exemplary configuration, the number of turns (that is, the number of windings) of the spiral pattern needs to be increased.

However, the following issues are conceivable for the exemplary antenna device. Specifically, since the spiral pattern is provided using a ground plate surface, for example, by etching, an increase in the number of turns of the spiral pattern means a reduction in the ground plate area. On the other hand, if the area of the ground plate is too small with respect to the target frequency, the operation of the antenna device becomes unstable. In other words, in order to stabilize the operation of the antenna device, the ground plate needs to be formed sufficiently larger than a predetermined area determined according to the target frequency. For that reason, there is a limit to the reduction in the resonance frequency by the method used for the exemplary antenna device.

Also, the configuration of the exemplary antenna device increases the inductance while decreasing the capacitance.

When the capacitance of the antenna device is reduced and the inductance is increased, a Q value indicating a sharpness of a peak of the resonance is increased, and a robustness of the antenna device is lowered. This is because the Q value becomes larger as the inductance becomes larger and as the capacitance becomes smaller, as shown in the following Expression. In Expression, R represents a pure resistance value, L represents an inductance, and C represents a capacitance.

$$Q = \frac{1}{R}\sqrt{\frac{L}{C}} \quad \text{[Expression 1]}$$

Figure 2:
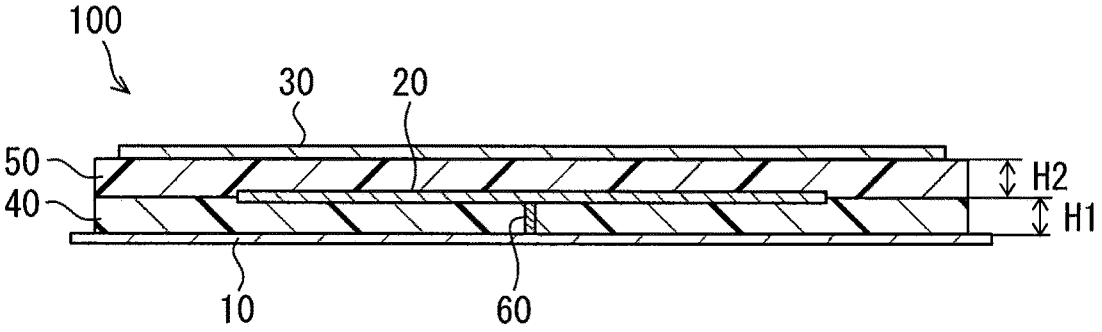
FIG. 2 is a cross-sectional view of the antenna device 100 taken along a line II-II shown in FIG. 1.

Embodiments will be described below with reference to the drawings. FIG. 1 is an external perspective view showing an example of a schematic configuration of an antenna device 100 according to the present embodiment. FIG. 2 is a cross-sectional view of the antenna device 100 taken along a line II-II shown in FIG. 1.

The antenna device 100 is configured to transmit and receive radio waves of a predetermined target frequency. It is needless to say that as another mode, the antenna device 100 may be used for only either transmit or receive.

As one example, a target frequency is exemplified by 850 MHz. It is needless to say that the target frequency may be designed as appropriate, and as another mode, for example, 300 MHz, 760 MHz, 900 MHz, 5.9 GHz, or the like may be used. The antenna device 100 can transmit and receive not only the target frequency but also radio waves having a frequency within a predetermined range before and after the target frequency. For the sake of convenience, a band of a frequency that can be transmitted and received by the antenna device 100 will also be referred to as an operating band hereinafter.

The antenna device 100 is connected to a radio device (not shown) through, for example, a coaxial cable, and signals received by the antenna device 100 are sequentially output to the radio device. The antenna device 100 converts an electric signal input from the radio device into a radio wave and radiates the radio wave into a space. The radio device uses the signal received by the antenna device 100, and supplies a high-frequency power corresponding to a transmission signal to the antenna device 100.

In the present embodiment, a case in which the antenna device 100 and the radio device are connected to each other by a coaxial cable is assumed, but the connection may be performed by using other well-known communication cables such as a feeder line. The antenna device 100 and the radio device may be connected to each other through a matching circuit, a filter circuit, or the like, which are well known, in addition to the coaxial cable.

Hereinafter, a specific configuration of the antenna device 100 will be described. As shown in FIGS. 1 and 2, the antenna device 100 includes a ground plate 10, a patch portion 20, an additional conductor 30, a first support portion 40, a second support portion 50, a short-circuit portion 60, and a feed line 70. For the sake of convenience, the respective portions will be described with a side of the ground plate 10 on which the patch portion 20 and the additional conductor 30 are provided as an upper side of the antenna device 100.

The ground plate 10 is a plate-shape (including foil) conductor member made of a conductor such as copper. The ground plate 10 is electrically connected to an external conductor of a coaxial cable, and provides a ground potential in the antenna device 100 (in other words, a ground potential). The ground plate 10 may have a size necessary for stably operating the antenna device 100. An area of the ground plate 10 is at least larger than that of the patch portion 20, and is preferably 1.5 times or more of the area of the patch portion 20. As an example, it is assumed that the ground plate 10 has an area equivalent to 1.8 times that of the patch portion 20.

In addition, a shape of the ground plate 10 as viewed from a top side (hereinafter referred to as a planar shape) may be appropriately designed. As an example, the planar shape of the ground plate 10 is a square shape, but as another mode, the planar shape of the ground plate 10 may be a rectangular shape or another polygonal shape. The planar shape of the ground plate 10 may also have a circular (including ellipse) shape. It is needless to say that the planar shape of the ground plate 10 may be a combination of a straight line portion and a curved line portion.

The patch portion 20 is a plate-shape conductor member made of a conductor such as copper. The patch portion 20 is disposed so as to face the ground plate 10 across the first support portion 40. In this example, the planar shape of the patch portion 20 is a square, but may be a rectangular shape, or may be a shape other than the rectangular shape (for example, a circular shape, an octagonal shape, or the like). In addition, a notched portion or a slit may be provided in a part of the planar shape of the patch portion 20. For example, a notch as a degenerate separation element may be provided in a pair of diagonal portions.

The additional conductor 30 is a plate-shape (including foil) conductor member made of a conductor such as copper. The additional conductor 30 is disposed so as to face the patch portion 20 with a predetermined distance between the additional conductor 30 and the patch portion 20 through the second support portion 50. The additional conductor 30 is preferably larger than the patch portion 20 so as to cover the patch portion 20 in the top view. As an example, a planar shape of the additional conductor 30 is a shape in which the patch portion 20 is similarly enlarged so that an area of the additional conductor 30 is 1.2 times the area of the patch portion 20.

The additional conductor 30 is disposed so that a center of the additional conductor 30 overlaps with a center of the patch portion 20 (hereinafter referred to as a patch center point) in the top view. The center of the additional conductor 30 or the patch center point may be a point corresponding to each center of gravity of the additional conductor 30 and the patch center point. Since the additional conductor 30 of the present embodiment has the square shape, the center of the additional conductor 30 corresponds to an intersection of diagonal lines of a square. Since the patch portion 20 of the present embodiment has a square shape, the patch center point corresponds to the intersection of the diagonal lines of the square.

As an example, the planar shape of the additional conductor 30 is a similar shape of the patch portion 20, but is not limited to the above shape. The planar shape of the additional conductor 30 may be a rectangle other than the square, or may be another polygonal shape. Further, the planar shape of the additional conductor 30 may have a circular shape. Further, the additional conductor 30 may be smaller than the patch portion 20 as will be described later as Modification 1.

The first support portion 40 is a member for disposing the ground plate 10 and the patch portion 20 so as to face each other at a predetermined interval H1. The first support portion 40 may be realized with the use of a dielectric material such as a resin. For convenience, in the first support portion 40, one surface on which the patch portion 20 is disposed is referred to as a patch side surface, and another surface on which the ground plate 10 is disposed is referred to as a ground plate side surface.

In the present embodiment, as an example, the first support portion 40 is a plate-shape member having a thickness such that a distance between the ground plate 10 and the patch portion 20 is H1. With the adjustment of a thickness of the first support portion 40, the distance between the patch portion 20 and the ground plate 10 can be adjusted. The interval H1 may be sufficiently small with respect to a wavelength (hereinafter referred to as a target wavelength) of the radio wave of the target frequency, and a specific value may be appropriately determined by simulation or test.

It should be noted that the first support portion 40 may fulfill the above-mentioned function, and a shape of the first support portion 40 is not limited to a plate-shape. The first support portion 40 may be configured by multiple pillars that support the ground plate 10 and the patch portion 20 so as to face each other at a predetermined distance H1. In the present embodiment, a space between the ground plate 10 and the patch portion 20 is filled with resin as the first support portion 40, but the present disclosure is not limited to the above configuration. The space between the ground plate 10 and the patch portion 20 may be hollow or vacuum. Furthermore, the structures exemplified above may be combined together.

The interval H1 functions as a parameter for adjusting a length of the short-circuit portion 60 (in other words, an inductance provided by the short-circuit portion 60) as will be described later. The distance H1 also functions as a parameter for adjusting the capacitance formed by the ground plate 10 and the patch portion 20 facing each other. The interval H1 is preferably at least one tenth or less of the target wavelength. For example, the internal H1 may be set to one fiftieth or one hundredth of the target wavelength.

The second support portion 50 is a member for disposing the patch portion 20 and the additional conductor 30 so as to face each other at a predetermined distance H2. The second support portion 50 may be realized with the use of a dielectric material such as a resin. In the present embodiment, as an example, the second support portion 50 is a plate-shape member having a thickness such that the distance between the patch portion 20 and the additional conductor 30 is H2. With the adjustment of the thickness of the second support portion 50, the distance H2 between the patch portion 20 and the additional conductor 30 can be adjusted.

It should be noted that the second support portion 50 may fulfill the above-mentioned function, and a shape of the second support portion 50 is not limited to the plate-shape. The second support portion 50 may be configured by multiple pillars that support the patch portion 20 and the additional conductor 30 so as to face each other at a predetermined distance H2. In the present embodiment, a space between the patch portion 20 and the additional conductor 30 is filled with resin as the second support portion 50, but the present disclosure is not limited to the above configuration. The space between the patch portion 20 and the additional conductor 30 may be hollow or vacuum.

The distance H2 also functions as a parameter for adjusting the capacitance formed by the patch portion 20 and the additional conductor 30 facing each other. Like the interval H1, the interval H2 may be sufficiently small with respect to the target wavelength, and a specific value may be appropriately determined by simulation or test.

The short-circuit portion 60 is a conductive member that electrically connects the ground plate 10 and the patch portion 20. The short-circuit portion 60 may be realized by using a conductive pin, (hereinafter referred to as a short pin). An inductance of the short-circuit portion 60 can be adjusted by adjusting a length or the like of the short pin serving as the short-circuit portion 60.

When the antenna device 100 is realized on the basis of a printed wiring board, a via provided in the printed circuit board may function as the short-circuit portion 60. In any case, the short-circuit portion 60 is a linear member having one end electrically connected to the ground plate 10 and the other end electrically connected to the patch portion 20.

The short-circuit portion 60 is provided so as to be located at the patch center point. It should be noted that the short-circuit portion 60 does not necessarily have to be disposed at the patch center point. When the short circuiting portion 60 is disposed at a position other than the patch center point, a deviation amount in directivity according to the amount of deviation from the patch center point occurs. In a range in which the deviation of the directivity falls within a predetermined allowable range, the short-circuit portion 60 may be disposed at a position deviated from the patch center point.

A feed line 70 is a microstrip line provided on the patch side surface of the first support portion 40 to supply a power to the patch portion 20. One end of the feed line 70 is electrically connected to the inner conductor of the coaxial cable, and the other end of the feed line 70 is electrically connected to the patch portion 20. A connection portion between the feed line 70 and the patch portion 20 corresponds to a feeding point for the patch portion 20. A predetermined interval at which the feed line 70 and the patch portion 20 are electromagnetically coupled with each other at the target frequency may be provided at a connection portion between the feed line 70 and the patch portion 20.

The antenna device 100 described above is used, for example, in a moving object such as a vehicle. When the antenna device 100 is used in the vehicle, the ground plate 10 may be disposed substantially horizontally in a roof of the vehicle so that a direction from the ground plate 10 toward the patch portion 20 substantially coincides with a zenith direction.

Figure 3:
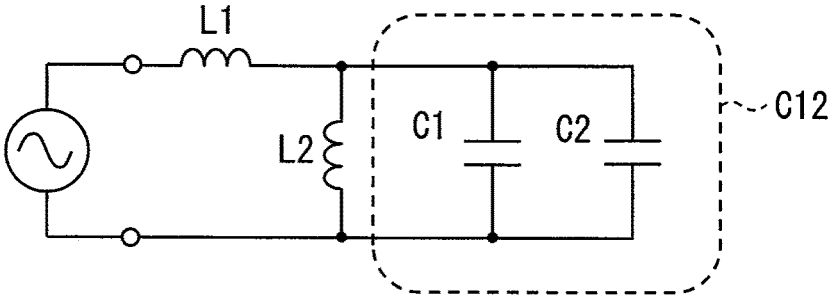
FIG. 3 is an equivalent circuit diagram of the antenna device 100.

An equivalent circuit of the antenna device 100 will be described. FIG. 3 shows an equivalent circuit of the antenna device 100. An inductor L1 is an element derived from the patch portion 20 and has an inductance corresponding to the shape of the patch portion 20. An inductor L2 is an element derived from the short-circuit portion 60 and has an inductance corresponding to the length of the short-circuit portion 60.

A capacitor C1 is an element corresponding to the capacitance formed by the ground plate 10 and the patch portion 20. The capacitor C1 has a capacitance corresponding to the area of the patch portion 20 and the distance H1 between the ground plate 10 and the patch portion 20. A capacitor C2 is an element corresponding to the capacitance formed by the patch portion 20 and the additional conductor 30. The capacitor C2 has a capacitance corresponding to the area of the additional conductor 30 and the distance H2 between the patch portion 20 and the additional conductor 30.

Since the capacitor C1 is connected in parallel with the capacitor C2 in the equivalent circuit, the capacitor C1 and the capacitor C2 can be regarded as one capacitor (hereinafter referred to a combined capacitor) C12. A capacitance of the combined capacitor C12 is a sum of the capacitance of the capacitor C1 and the capacitance of the capacitor C2.

The combined capacitor C12 is connected in parallel with the inductor L2. For that reason, the antenna device 100 resonates in parallel at a frequency determined according to the capacitance of the combined capacitor C12 and the inductance of the inductor L2 (hereinafter referred to as a parallel resonance frequency). The parallel resonance frequency in this example corresponds to a frequency referred to as a zero-order resonance frequency in a metamaterial antenna.

According to the configuration described above, the capacitance of the combined capacitor C12 and the inductance of the inductor L2 are adjusted so that the parallel resonance frequency coincides with the target frequency, thereby being capable of allowing the antenna device 100 to resonate in parallel at the target frequency.

For example, when the distance H1 between the ground plate 10 and the patch portion 20 is kept constant, a target capacitance necessary for parallel resonance is calculated according to the inductance of the inductor L2 and the target frequency. When the distance H1 between the ground plate 10 and the patch portion 20 is kept constant, the length of the short-circuit portion 60 is also a constant value. For that reason, the remaining parameters can be designed by setting the inductance of the inductor L2 to a constant value corresponding to the interval H1.

Next, the capacitance to be provided in each of the capacitor C1 and the capacitor C2 may be determined so that the capacitance of the combined capacitor C12 coincides with the target capacitance, and the shape and placement of the member corresponding to each capacitor may be determined. The capacitance of the capacitor C1 can be adjusted by the area of the patch portion 20. The capacitance of the capacitor C2 can be adjusted according to the distance H2 and the area of the additional conductor 30.

That is, the shape and placement of each element, such as the size of the patch portion 20, the size of the additional conductor 30, and the distance H2 between the patch portion 20 and the additional conductor 30, are appropriately adjusted so that the antenna device 100 resonates in parallel at the predetermined target frequency. It is needless to say that as another mode, the distance H1 between the ground plate 10 and the patch portion 20 may be treated as an adjustable parameter instead of a fixed value.

The operation of the antenna device 100 will be described. An operation in the case where the antenna device 100 resonates in parallel will be described. As an example, it is assumed that the additional conductor 30 is formed to be larger than the patch portion 20 so as to cover the patch portion 20 in the top view (for example, so as to have an area ratio of 1.2 times).

When the antenna device 100 resonates in parallel, an electric field perpendicular to the ground plate 10 is generated between the ground plate 10 and the additional conductor 30 (in particular, between the ground plate 10 and the patch portion 20). The vertical electric field propagates from the short-circuit portion 60 toward an outer edge portion of the patch portion 20 and an outer edge portion of the additional conductor 30. At the outer edge portion of the additional conductor 30, the vertical electric field becomes a vertically polarized electric field and propagates through a space. In this manner, the antenna device 100 radiates a vertically polarized wave in a direction orthogonal to the thickness direction of the antenna device 100 (hereinafter referred to as a centrifugal direction), at the outer edge portion of the additional conductor 30.

The antenna device 100 has the same gain in all directions from the patch center point toward the outer edge portion of the additional conductor 30. In particular, when the antenna device 100 is placed so that the ground plate 10 is horizontal, the antenna device 100 operates as a metamaterial antenna having no directivity with respect to the horizontal direction.

Figure 4:
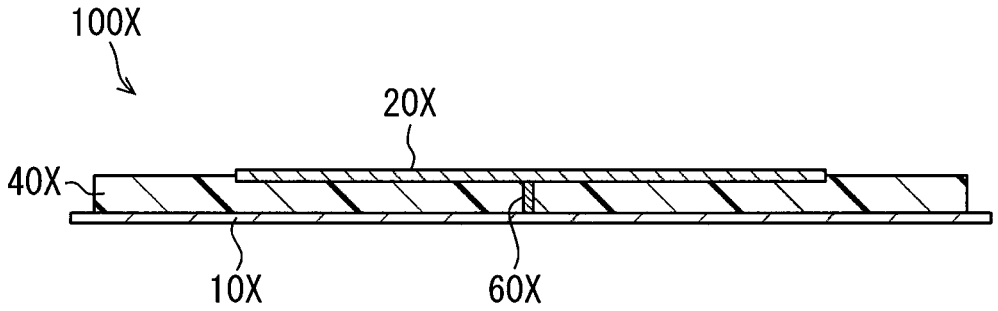
FIG. 4 is a diagram showing a configuration of an antenna device 100X in a comparative configuration.

The advantages of the present embodiment will be described. Next, an antenna device 100X as a comparative configuration is introduced, and the advantages of the present embodiment will be described. As shown in FIG. 4, an antenna device 100X as a comparative configuration includes a ground plate 10X, a patch portion 20X, a support portion 40X, a short-circuit portion 60X, and a feed line 70X. In other words, the antenna device 100X as a comparative configuration corresponds to a configuration in which the additional conductor 30 and the second support portion 50 are removed from the antenna device 100 of the present embodiment.

The patch portion 20X has the same shape and the same area as those of the patch portion 20 of the present embodiment, and a capacitance formed between the ground plate 10X and the patch portion 20X is equal to the capacitance of the capacitor C1 of the present embodiment. An inductance provided by the short-circuit portion 60X is also assumed to be equal to the inductance provided by the short circuit section 60. The support portion 40X is a member corresponding to the first support portion 40. In this comparative configuration, parallel resonance is generated by the capacitance formed between the ground plate 10X and the patch portion 20X and the inductance of the short-circuit portion 60X.

On the other hand, in the configuration of the present embodiment, the capacitor C2 derived from the additional conductor 30 is connected in parallel to the capacitor C1 formed by the ground plate 10 and the patch portion 20. As a result, the capacitance contributing to the generation of the parallel resonance is a total value of the capacitor C2 and the capacitor C1.

Therefore, the capacitance connected in parallel with the inductance provided by the short-circuit portion 60 according to the present embodiment is larger than the capacitance connected in parallel with the inductance provided by the short circuit section 60X in the comparative configuration. A parallel resonance frequency F becomes lower as the inductance L becomes larger and the capacitance C becomes larger, as expressed by the following Expression.

$$f = \frac{1}{2\pi\sqrt{LC}} \quad \text{[Expression 2]}$$

Therefore, the parallel resonance frequency of the antenna device 100 according to the present embodiment is lower than the parallel resonance frequency of the antenna device 100X in the comparative configuration. In other words, according to the above configuration, the parallel resonance frequency can be reduced as compared with the comparative configuration including the patch portion 20X of the same size.

Figure 5:
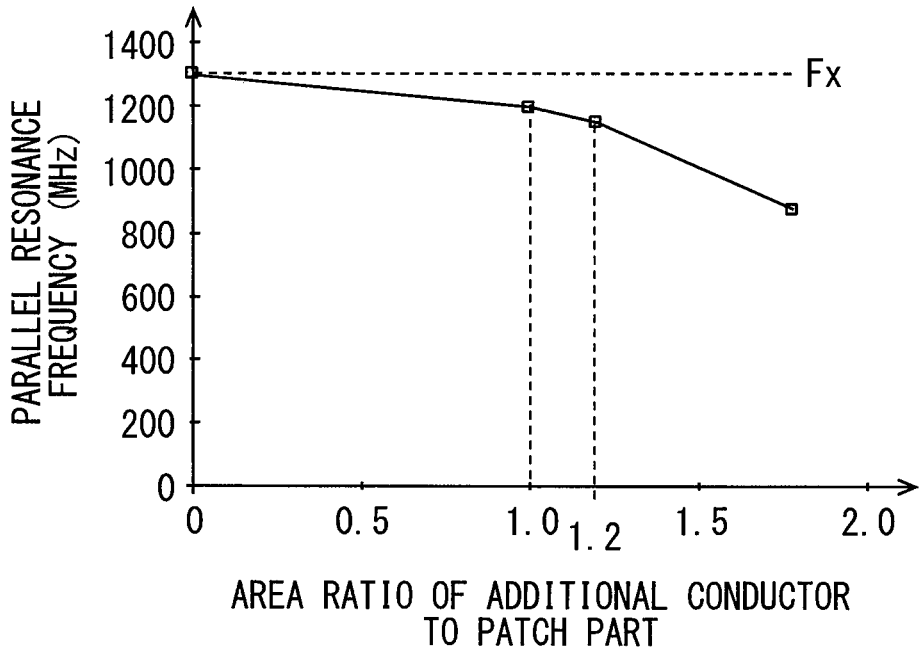
FIG. 5 is a graph showing a relationship between an area ratio of an additional conductor 30 to a patch portion 20 and a parallel resonance frequency.

As shown in FIG. 5, the larger the additional conductor 30, the higher the effect of reducing the parallel resonance frequency. FIG. 5 is a graph showing a relationship between an area ratio of the additional conductor 30 to the patch portion 20 and a parallel resonance frequency in the antenna device 100 in which the patch portion 20 and the short-circuit portion 60 are designed so that a resonance frequency Fx becomes 1300 MHz when the additional conductor 30 is not provided. As shown in FIG. 5, it can be seen that the parallel resonance frequency is reduced by providing the additional conductor 30. Further, the area of the additional conductor 30 is set to be larger than the area of the patch portion 20 (in other words, the area ratio is set to be larger than 1), thereby being capable of reducing the parallel resonance frequency by 100 MHz or more. In particular, the area ratio is set to 1.2 or more, thereby being capable of enhancing the effect of reducing the parallel resonance frequency.

In the comparative configuration described above, the capacitance formed by the ground plate 10X and the patch portion 20X needs to be a capacitance (that is, the target capacitance) that resonates in parallel with the inductance of the short-circuit portion 60X at the target frequency. In other words, the area of the patch portion 20X needs to be an area corresponding to the target capacitance.

On the other hand, according to the configuration of the present embodiment, the target capacitance is achieved by a total of the capacitance of the capacitor C1 formed by the patch portion 20 and the capacitor C2 provided by the additional conductor 30. Therefore, the capacitance of the capacitor C1 formed by the patch portion 20 does not need to coincide with the target capacitance, and the area of the patch portion 20 can be made smaller than that of the patch portion 20X in the conventional structure.

Therefore, according to the above configuration, when a certain predetermined frequency is set as the target frequency, the antenna area can be reduced as compared with the comparative configuration. For example, when 850 MHz is the target frequency, the additional conductor 30 of the present embodiment is set to the same size as that of the ground plate 10, thereby being capable of reducing the antenna area by about 37% as compared with the comparative configuration.

Although the embodiments have been described above, the present disclosure is not limited to the embodiments described above, and various modifications described below are included in the technical scope of the present disclosure, and can be implemented by various modifications within a scope that does not depart from the spirit of the present disclosure described below.

Members having the same functions as those described in the above embodiment are denoted by the same reference numerals, and descriptions thereof are omitted. When only a part of the configuration is referred to, the configuration of the embodiment described above can be applied to other parts.

Figure 6:
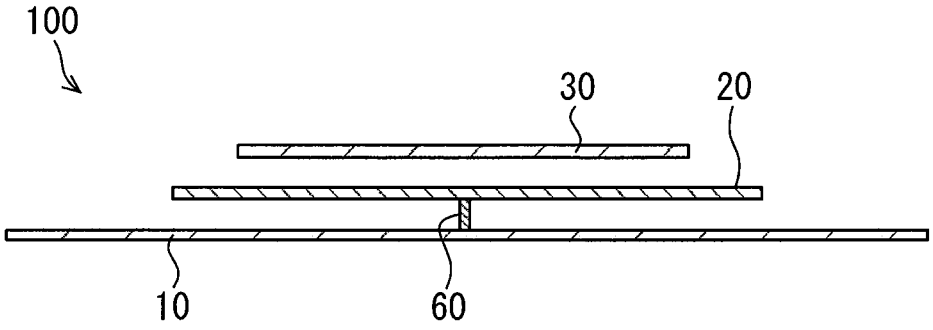
FIG. 6 is a diagram showing a schematic configuration of an antenna device 100 according to Modification 1.

Modification 1 will be described. In the embodiment described above, an aspect in which the additional conductor 30 is formed larger than the patch portion 20 is described, but the present disclosure is not limited to the above configuration. As shown in FIG. 6, the additional conductor 30 may be set to be smaller than the patch portion 20. In FIG. 6, the first support portion 40 and the second support portion 50 are not shown.

Figure 7:
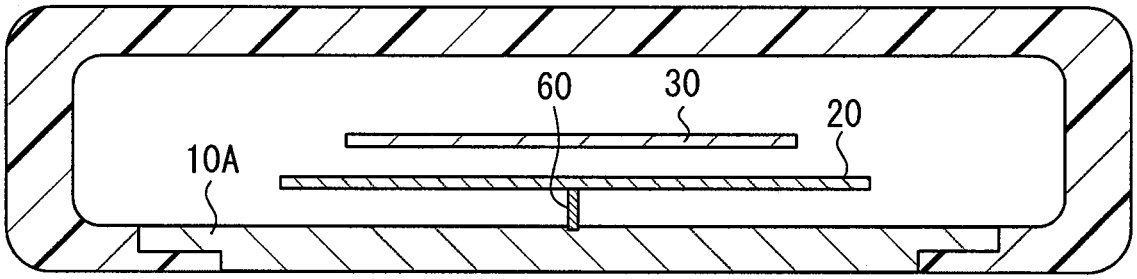
FIG. 7 is a diagram showing a schematic configuration of an antenna device 100 according to Modification 2.

Modification 2 will be described. When the antenna device 100 is accommodated in a housing having a plate-like metal portion, the plate-like metal portion of the housing may be used as the ground plate 10. FIG. 7 conceptually represents such an embodiment. Reference numeral 10A in FIG. 7 denotes a metal portion of the housing which functions as the ground plate 10. A side surface of the housing accommodating the antenna device 100 is made of a material (for example, resin) that does not hinder the propagation of radio waves.

Figure 8:
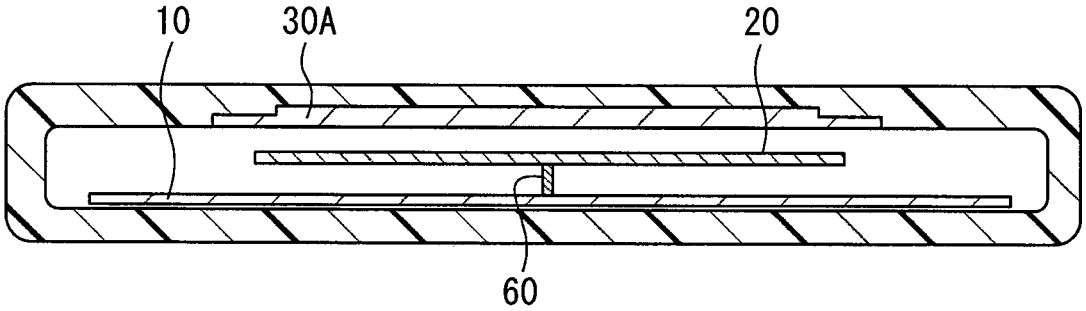
FIG. 8 is a diagram showing a schematic configuration of an antenna device 100 according to Modification 3.

Modification 3 will be described. When the antenna device 100 is accommodated in a housing having a plate-like metal portion, the plate-like metal portion of the housing may be used as the additional conductor 30. FIG. 8 conceptually shows such an embodiment. Reference numeral 30A in FIG. 8 denotes a metal portion of the housing which functions as the additional conductor 30. In the same manner as in Modification 2, it is assumed that the side surface portion of the housing accommodating the antenna device 100 is made of a material (for example, resin) that does not hinder the propagation of radio waves.

The antenna device illustrated above includes a ground plate that is a plate-shaped conductor member, a patch portion that is a plate-shaped conductor member placed to be opposed to the ground plate with a predetermined distance therebetween, a short-circuit portion that is a conductor member electrically connecting together the patch portion and the ground plate, and an additional conductor that is a plate-shaped conductor member placed to be opposed to the patch portion with a predetermined distance therebetween. The additional conductor is placed on a side of the patch portion on which the ground plate is not placed. An inductance of the short-circuit portion, a capacitance formed by the ground plate and the patch portion, and a capacitance formed by the patch portion and the additional conductor are used to perform parallel resonance.

In the above configuration, the short-circuit portion has a predetermined inductance corresponding to a length of the short-circuit portion, and the patch portion forms a capacitance corresponding to an area of the patch portion between the patch portion and the ground plate. In an equivalent circuit of the antenna device, the capacitance formed by the ground plate and the patch portion is connected in parallel with the inductance derived from the short-circuit portion.

The additional conductor forms a capacitance between the additional conductor and the patch portion in accordance with a distance from the patch portion and the area of the additional conductor. The capacitance derived from the patch portion and the additional conductor is connected in parallel to the capacitance formed between the ground plate and the patch portion in the equivalent circuit of the antenna device.

Therefore, in the above configuration, a total value of the capacitance derived from the ground plate and the patch portion and the capacitance derived from the patch portion and the additional conductor may be the capacitance that causes a parallel resonance at the inductance of the short-circuit portion and the target frequency. In other words, according to the configuration described above, the area of the patch portion can be reduced as compared with the comparative configuration in which the same frequency is used as the target frequency. As described above, the reduction in the area of the patch portion leads to the reduction in the antenna area. The comparative configuration refers to a configuration in which no additional conductor is provided on an upper side of the patch portion. The upper side of the patch portion is a side where the ground plate does not exist for the patch portion.

Since the reduction of the antenna area by the configuration described above is achieved by the increase in the capacitance, there is no need to increase the inductance. Therefore, it is possible to reduce the antenna area while reducing the increase in the Q value.

While the present disclosure has been described with reference to embodiments thereof, it is to be understood that the disclosure is not limited to the embodiments and constructions. The present disclosure is intended to cover various modification and equivalent arrangements. In addition, the various combinations and configurations, other combinations and configurations, including more, less or only a single element, are also within the spirit and scope of the present disclosure.

What is claimed is:

1. An antenna device comprising:

a ground plate that is a plate-shaped conductor member;

a patch portion that is a plate-shaped conductor member placed to be opposed to the ground plate with a predetermined distance therebetween;

a short-circuit portion that is a conductor member electrically connecting together the patch portion and the ground plate;

an additional conductor that is a plate-shaped conductor member placed to be opposed to the patch portion with a predetermined distance therebetween; and a feed line that is configured to supply power to the patch portion, wherein:

a center of the additional conductor is arranged so as to overlap a center of the patch portion and a center of the short-circuit portion in a top view;

the additional conductor is placed on a side of the patch portion on which the ground plate is not placed;

the additional conductor is not electrically connected to the patch portion; and an inductance of the short-circuit portion, a capacitance formed by the ground plate and the patch portion, and a capacitance formed by the patch portion and the additional conductor are used to perform parallel resonance.

2. The antenna device according to claim 1, wherein the additional conductor is formed to be larger than the patch portion to cover the patch portion in their top view.

3. The antenna device according to claim 2, wherein:

an area of the ground plate is 1.5 or more times larger than an area of the patch portion; and an area of the additional conductor is 1.2 or more times larger than the area of the patch portion, and is smaller than the area of the ground plate.

4. The antenna device according to claim 1, wherein a space between the patch portion and the additional conductor is filled with resin.

5. The antenna device according to claim 1, wherein the ground plate is realized by using a metal portion of a housing that accommodates the antenna device.

6. The antenna device according to claim 1, wherein the additional conductor is realized by using a metal portion of a housing accommodating the antenna device.

7. The antenna device according to claim 1, wherein a capacitor which is an element corresponding to the capacitance formed by the ground plate and the patch portion, a capacitor which is an element corresponding to the capacitance formed by the patch portion and the additional conductor, and an inductor which is an element corresponding to the inductance of the short-circuit portion are connected in parallel with each other in an equivalent circuit of the antenna device to produce the parallel resonance performed by the antenna device.

* * * * *